US010295264B2

(12) United States Patent
Lehmann

(10) Patent No.: US 10,295,264 B2
(45) Date of Patent: May 21, 2019

(54) HEAT EXCHANGING DEVICE WITH CONNECTED COLLECTING CHAMBERS

(71) Applicant: HYDAC COOLING GMBH, Sulzbach/Saar (DE)

(72) Inventor: Frank Guenter Lehmann, Spiesen-Elversberg (DE)

(73) Assignee: HYDAC COOLING GMBH, Sulzbach/Saar (DE)

( * ) Notice: Subject to any disclaimer, the term of this patent is extended or adjusted under 35 U.S.C. 154(b) by 100 days.

(21) Appl. No.: 15/114,442

(22) PCT Filed: Dec. 19, 2014

(86) PCT No.: PCT/EP2014/003446
§ 371 (c)(1),
(2) Date: Jul. 27, 2016

(87) PCT Pub. No.: WO2015/117635
PCT Pub. Date: Aug. 13, 2015

(65) Prior Publication Data

US 2016/0341482 A1 Nov. 24, 2016

(30) Foreign Application Priority Data

Feb. 8, 2014 (DE) ..... 10 2014 001 703

(51) Int. Cl.
*F28F 9/26* (2006.01)
*F28D 1/053* (2006.01)
(Continued)

(52) U.S. Cl.
CPC ..... *F28D 1/05375* (2013.01); *F28D 1/024* (2013.01); *F28D 1/0443* (2013.01);
(Continued)

(58) Field of Classification Search
CPC .... F28D 1/0452; F28D 1/0443; F28D 1/0417; F28D 1/05375; F28D 1/024
(Continued)

(56) References Cited

U.S. PATENT DOCUMENTS 2,124,787 A * 7/1938 Lachasse ..... B64D 33/10 165/144
2012/0017877 A1 1/2012 Laube et al.
2012/0073793 A1* 3/2012 Kuehne ..... F28D 9/0062 165/170

FOREIGN PATENT DOCUMENTS

DE 20 25 207 3/1975
DE 44 41 503 5/1996
(Continued)

OTHER PUBLICATIONS

Translation of German Patent Document DE 10322165 A1 entitled Translation—DE 10322165 A1.*
(Continued)

*Primary Examiner* — Paul Alvare
(74) *Attorney, Agent, or Firm* — Wenderoth, Lind & Ponack, L.L.P.

(57) ABSTRACT

A fluid/air heat exchanging device (2) has fluid-conducting outside collecting chambers (6, 10) having an inlet (8) or outlet (12) and being connected to one another via duct-shaped fluid guides (14) that control the temperature of a fluid flow by an air flow. The air flows in duct-shaped air guides separated from the fluid guides (14). A further collecting chamber (18; 20, 22) is inserted between outside collecting chambers (6, 10). The further collecting chamber (18; 20, 22) is arranged parallel to the outside collecting chambers (6, 10). All the fluid guides (14) are connected to the further collecting chamber and one of the outside collecting chambers (6, 10).

8 Claims, 3 Drawing Sheets

(51) Int. Cl.

| | |
|---|---|
| ***F28F 9/02*** | (2006.01) |
| ***F28D 1/02*** | (2006.01) |
| *F28D 1/04* | (2006.01) |

(52) U.S. Cl.
CPC ..... *F28D 1/05333* (2013.01); *F28D 1/05383* (2013.01); *F28F 9/02* (2013.01); *F28D 1/0417* (2013.01); *F28D 1/0452* (2013.01)

(58) Field of Classification Search
USPC ..... 165/144
See application file for complete search history.

(56) References Cited

FOREIGN PATENT DOCUMENTS

| | | | | |
|---|---|---|---|---|
| DE | 10322165 | A1 * | 12/2004 | ..... F25B 39/04 |
| DE | 10 2010 046 913 | | 3/2012 | |
| DE | 10 2010 056 567 | | 7/2012 | |
| FR | 2 873 799 | | 2/2006 | |
| JP | 2010-107131 | | 5/2010 | |
| WO | 2005/116415 | | 12/2005 | |

OTHER PUBLICATIONS

International Search Report (ISR) dated Mar. 12, 2015 in International (PCT) Application No. PCT/EP2014/003446.

* cited by examiner

HEAT EXCHANGING DEVICE WITH CONNECTED COLLECTING CHAMBERS

FIELD OF THE INVENTION

The invention relates to a heat exchanging device, in particular a fluid/air heat exchanger. The device has individual fluid-conducting collecting chambers, each having an inlet or outlet for fluid supply and discharge and being connected to one another via duct-like fluid guides that control the temperature of, in particular cool, a fluid flow during operation of the device by an air flow. The air flows in duct-shaped air guides separated from the fluid guides in a medium-tight manner.

BACKGROUND OF THE INVENTION

Heat exchanging devices of this type, which are also referred to as finned coolers, are state of the art. With air as the cooling medium, such heat exchangers are often used for cooling hydraulic fluids for the working hydraulics of mechanical systems, such as construction machines or the like, for hydrostatic drive units or as oil coolers for heavily loaded gears, specifically in wind power stations. The document DE 10 2010 056 567 A1 discloses an example of the application of such a heat exchanger in a fluid/air cooling system to generate a cooling capacity for the hydraulic fluid in the hydraulic working circuit of an associated machine unit. During operation of such systems, the heat exchangers are subject to not only mechanical stresses, but they are also subject to thermal stresses in particular, due to the great range of temperatures that can arise at the system components during operation. Such stresses result both from the operating temperatures of the media involved, such as air and fluid, and from the influences of the ambient temperatures at the place of application of the heat exchangers, for example due to the climatic conditions at the place of application.

In the case of heat exchangers in the form of finned coolers with a conventional design that, as is revealed in DE 10 2010 046 913 A1, are made up of a bundle of plates lying on top of one another. Between the plates, duct-shaped air guides and fluid guides are alternately formed. For example, at high operating temperatures of the fluids resulting from swings in temperature of the type that occur in intermittent operation, stresses can occur in the bundle of components due to longitudinal expansion. Possible consequences include stress cracks in the bundle, which is joined together by soldering to form a rigid block, in particular in the region of the soldered seams. These stress cracks are accompanied by the danger of a malfunction of the heat exchanger, and thus, compromising the associated system. To avoid this danger, document DE 10 2010 046 913 A1 provides strips forming the soldering surfaces on the plates with a special profile shape, which leads to an approximately linear change in the bending strength of the shanks of the profile. An optimal bending behavior of the shanks is then obtained, and the risk of stress cracks at the soldering regions is minimized.

While the risk of interruption of operation in the case of swings in temperature over high temperature ranges is thus effectively avoided, problems can develop due to low temperatures arising at the heat exchanger. When corresponding systems are used in bitterly cold climatic zones, for example in northern areas of the USA, in Canada, Northern China or similar areas and when, in these applications, the systems are directly exposed to the environmental effects, for example, in the case of wind power stations, problems develop. The changes in viscosity of the fluid that occur at low temperatures during winter operation lead to pressure losses. Due to paraffin formation, which can take place in the fluids at low temperatures, a "freezing" of the heat exchanger can occur. To make fluid/air cooling systems suitable for winter, the heat exchangers concerned are conventionally designed with larger material thicknesses and/or the cooling air quantity is reduced by speed variance of the associated fan, for example, using control systems of the type described in DE 10 201 056 567 A1, cited above.

SUMMARY OF THE INVENTION

An object of the invention is to provide an improved heat exchanging device of the type under consideration that is distinguished by improved operating performance in the lower temperature range.

According to the invention, this object is basically achieved by a heat exchanging device having, as a significant feature of the invention, among the collecting chambers conducting the fluid to be temperature controlled, with each having a fluid inlet or outlet, three or more collecting chambers provided that are disposed parallel to one another relative to the flow direction extending between the inlet and outlet. Compared with the conventional design, in which there is flow through the heat exchanger via the fluid ducts extending between the two end-side collecting chambers along the entire length, the invention, comprising at least one additional collecting chamber disposed between end-side collecting chambers, halves both the run length and the volume flow per collecting chamber. The operational pressure loss is thus reduced to a quarter of the usual value, with corresponding improvement in the operating performance at low temperatures with the associated viscosity changes. The desired winter suitability can thus be achieved without greater wall thicknesses and also with a high air throughput, so that simpler fan drives can be used, resulting in overall significantly reduced production costs.

The device can advantageously be designed such that a collecting chamber with an inlet or outlet for fluid is disposed centrally between two groups of duct-shaped fluid guides separated from one another by this collecting chamber. The fluid guides open at their free ends facing away from one another into an exterior collecting chamber, which has an outlet or an inlet.

The heat exchanging device can also be made up of at least two fluid/air heat exchangers which, preferably disposed in a plane, point in a common fluid flow direction with their adjacent collecting chambers and have an inlet or outlet. The collecting chambers are each connected via the duct-shaped fluid guides forming the outlet or inlet for the fluid.

In an embodiment designed in this manner, having at least two fluid/air heat exchangers, one collecting chamber of a heat exchanger has an inlet and an outlet on opposite end areas. This collecting chamber can be connected in series to the inlet of the following collecting chamber of another heat exchanger.

The collecting chambers connected to one another in series can have an opposite flowthrough direction to one another when the device is in operation. The additional collecting chamber of the second heat exchanger connected in series to the one heat exchanger is connected with its outlet to the inlet of the collecting chamber of the one heat exchanger, which has an outlet at its other, opposite end. This arrangement, in turn, halves the run lengths of the fluid ducts and the volume flows inside the collecting chambers. In exemplary embodiments with two or more fluid/air heat exchangers, these can be disposed in desired spatial relationships relative to one another, so that the entire device can be easily adapted to given installation situations.

For particularly good operating performance in the low temperature range, in every heat exchanger, all collecting chambers used can be selected to be the same size in terms of volume, to obtain the same optimal flow conditions in all collecting chambers.

Furthermore and advantageously, across the entire construction height or construction length of a collecting chamber formed as a collecting box, the duct-shaped fluid guides can open into the collecting box. The air flow during operation of the device takes place essentially transverse to the fluid guide in the connected collecting chamber.

To increase the air throughput for an efficient heat exchange, in particular a cooling, an assigned fan device can preferably be disposed at the front side on the duct-shaped fluid guides.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Of the depicted air/fluid heat exchangers in the form of plate coolers, also referred to as finned coolers, the figures show only collecting chambers with a fluid inlet and/or fluid outlet and also the fluid flow course between collecting chambers that is illustrated only with flow arrows. The structural details of the fluid guides for the fluid flow between collecting chambers as well as the details of the air guides extending transverse to the fluid guides are omitted in the simplified sketch-type figures. As an example of this type of special design of a corresponding plate bundle, with duct-shaped fluid and air guides extending between the plates, reference is made to the already mentioned document DE 10 2010 046 913 A1.

Figure 1:
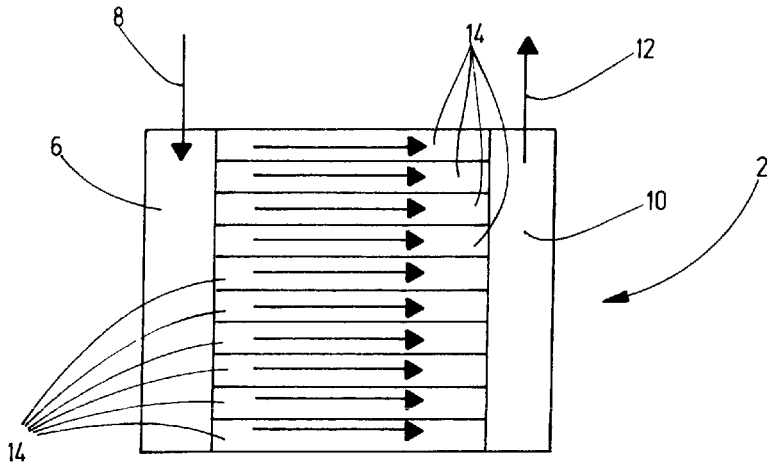
Fig.1 Prior art
FIG. 1 is a very schematically simplified functional diagram of a heat exchanging device according to the prior art, illustrating only the course of the fluid flow.

FIG. 1 shows a heat exchanging device 2 according to the prior art having a fluid collecting chamber 6 with a fluid inlet 8 and having a collecting chamber 10 with a fluid outlet 12. The collecting chambers 6 and 10 have box shapes with a preferably rectangular cross section and are disposed on two opposite outer sides of the heat exchanger. The collecting chambers 6, 10 extend across the entire height of the plate bundle and across the dimension perpendicular to the drawing plane, so that all fluid guides 14 open into the collecting chambers 6 and 10 with the unnumbered flow arrows. The direction of the flow runs from the collecting chamber 6 having the inlet 8 to the collecting chamber 10 with the outlet 12.

Figure 2:
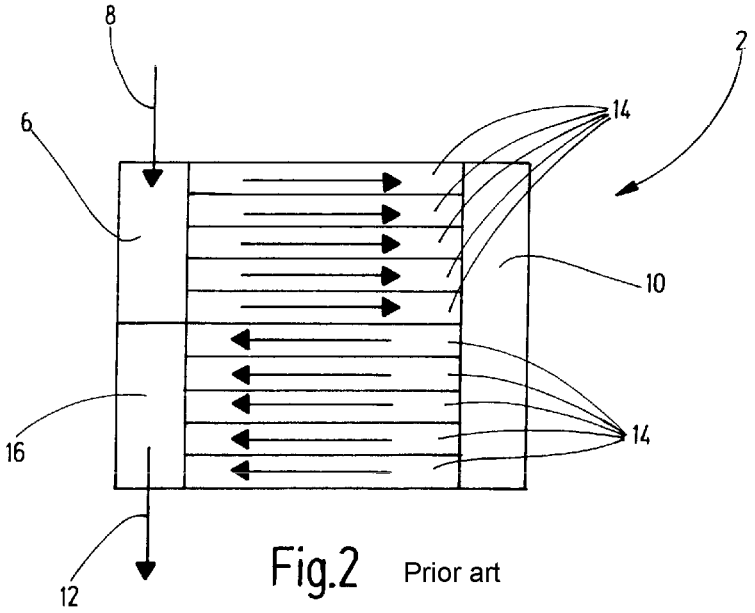
Fig.2 Prior art
FIG. 2 is a very schematically simplified functional diagram of a modified heat exchanging device according to the prior art.

FIG. 2 shows another exemplary embodiment of the prior art, wherein the fluid guides 14 again extend across the entire length of the distance between exterior collecting chambers. By contrast with FIG. 1, the collecting chamber 6 located on the left side extends only across half the height of the bundle. Another collecting chamber 16 is connected to this collecting chamber 6 and has fluid outlet 12. During operation, a flow occurs in this heat exchanging device 2 between the left exterior collecting chambers 6 and 16 and the opposite exterior collecting chamber 10 in a first flow direction and in a second flow direction.

Figure 3:
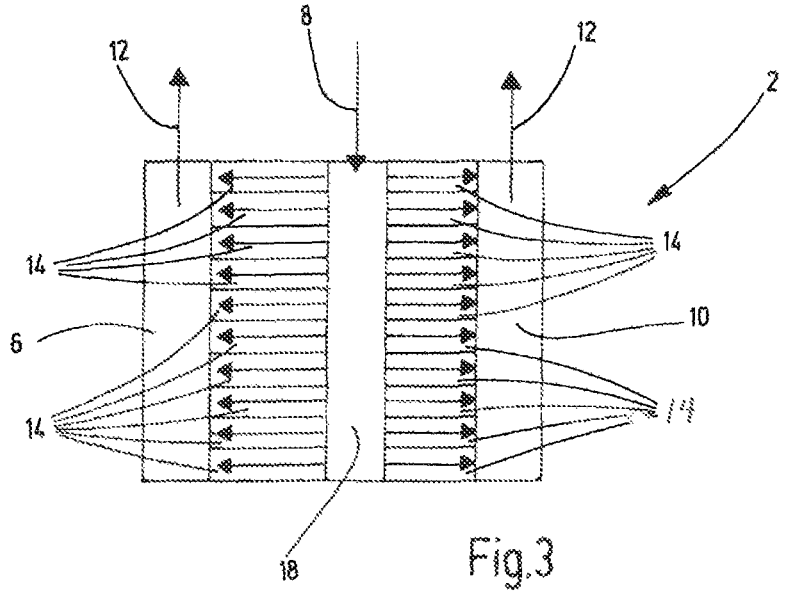
FIG. 3 a schematized depiction of a heat exchanging device according to a first exemplary embodiment of the invention.

FIG. 3 shows a first exemplary embodiment of a heat exchanger of the heat exchanging device 2 according to the invention. A third collecting chamber 18 is provided centrally between the collecting chambers 6 and 10 extending along opposing outer sides. The third collecting chamber extends parallel to the outer collecting chambers 6, 10. This third collecting chamber 18 has the fluid inlet 8. At each of the outer collecting chambers 6, 10, a fluid outlet 12 is provided. Inlet 8 and outlet 12 are each located on the same front side, i.e., the narrow side of the collecting chambers 6, 10, 18, which chambers are rectangular in cross-section. This arrangement results in half the volume flow of the fluid flow entering via the inlet 8 on each side of the central collecting chamber 18 in the fluid guides 14. When the run lengths are halved, the pressure loss is reduced to a quarter of the value reached with a full run length and full volume flow. This arrangement produces, even with thin-walled components permitting a high level of heat exchange efficiency, a heat exchanging device that is characterized by good operating characteristics even with the viscosity ranges encountered at low temperatures. The central collecting chamber 18 disposed parallel to the exterior collecting chambers 6, 10 has the same shape and the same volume as the exterior collecting chambers 6, 10.

Figure 4:
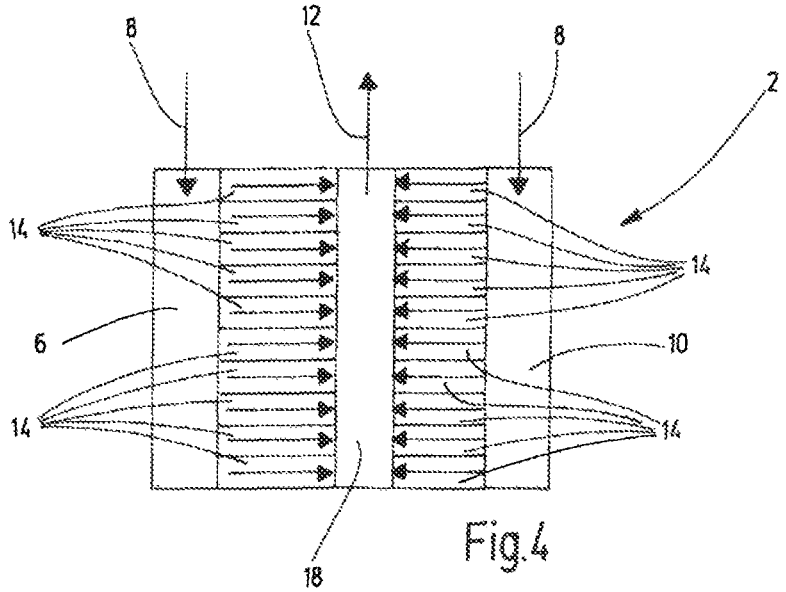
FIGS. 4 to 7 are schematized depictions of heat exchangers of a heat exchanging device according to a second, third, fourth and fifth exemplary embodiment of the invention, respectively.

The second exemplary embodiment depicted in FIG. 4, corresponds to the example of FIG. 3, except that the exterior collecting chambers 6, 10 form the inlet side with one fluid inlet 8 in each case. The central collecting chamber 18 has the fluid outlet 12. During operation, the ratios for run length, volume flow and pressure loss in the fluid guides 14 are once again the same as in the example of FIG. 3.

Figure 5:
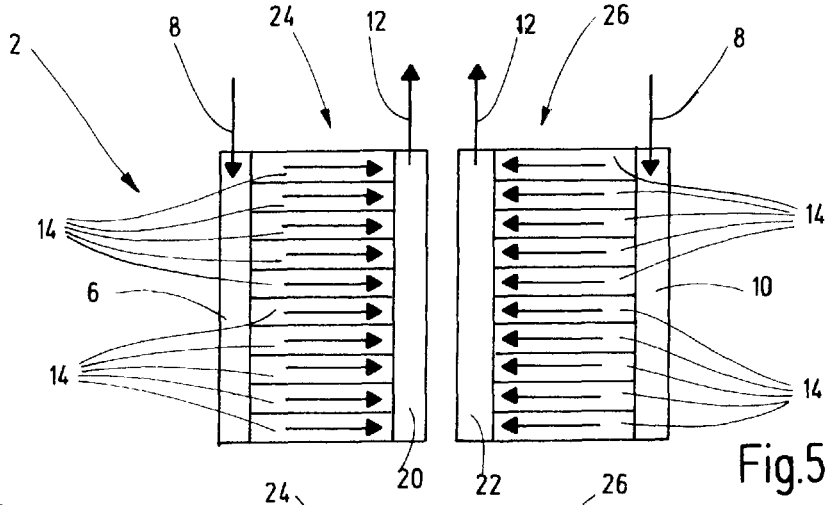
Figure 6:
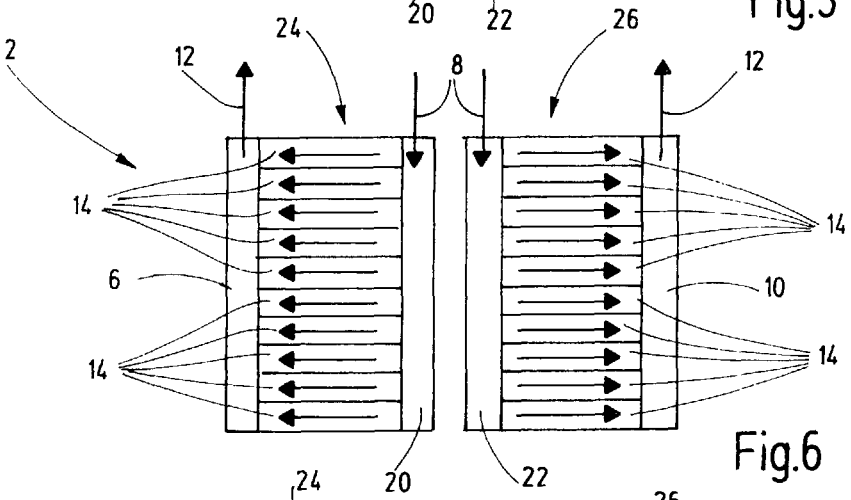
Figure 7:
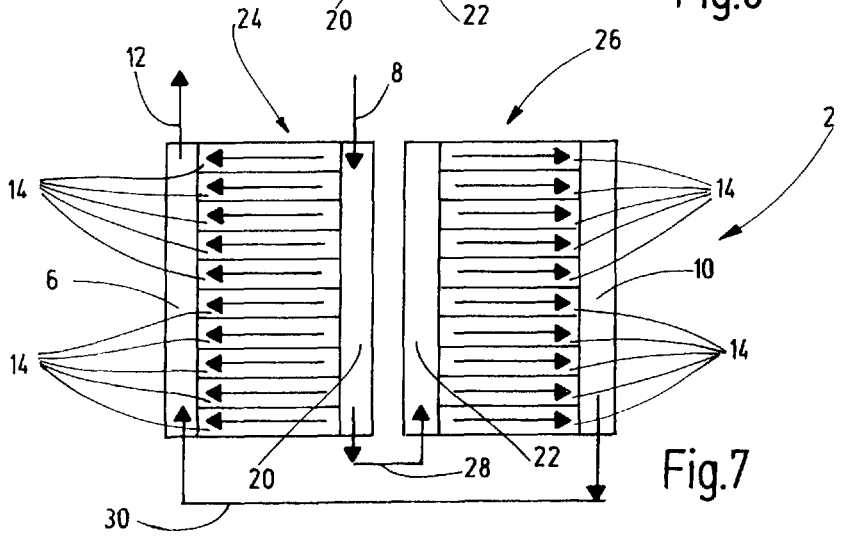

In the exemplary embodiments of FIGS. 5, 6 and 7, the entire heat exchanging device 2 has two central collecting chambers 20 and 22, instead of a single collecting chamber 18 disposed centrally between the exterior collecting chambers 6 and 10. As a result, the entire heat exchanging device 2 is divided into two heat exchangers 24 and 26. All collecting chambers 6, 10, 20 and 22 have the same box shape with a rectangular cross-section and have the same volume. The two exterior collecting chambers 6 and 10 each have a fluid inlet 8 as inlet sides. The centrally located collecting chambers 2 and 22 each have a fluid outlet 12. The inlets 8 and outlets 12 are each disposed at the same front side of the collecting chambers 6, 10, 20, 22. With regards to the fluid flow, flow conditions are produced corresponding to those of the two first exemplary embodiments of FIGS. 3 and 4, i.e., the shortened run lengths with a halved volume flow in the fluid guides 14 and with the resulting advantages for winter operation.

The exemplary embodiment of FIG. 6 corresponds to the exemplary embodiment of FIG. 5, except that the central collecting chambers 20 and 22 form the inlet sides with the inlets 8, while the exterior collecting chambers 6 and 10 have the outlets 12. The division of the entire heat exchanging device 2 into the heat exchangers 24 and 26 also permits adaptation to special installation situations by selection of the relative positioning of the heat exchangers 24 and 26.

The exemplary embodiment of FIG. 7 corresponds to the examples of FIGS. 5 and 6 with regards to the disposition of the collecting chambers 6, 10, 20 and 22. By contrast, only the heat exchanger 24 located on the left side in FIG. 7 has a fluid inlet 8 and a fluid outlet 12. The collecting chamber 20 having the inlet 8 is connected on the front end opposite the inlet 8 to the adjacent front side end of the collecting chamber 22 of the other heat exchanger 26 via a conduit 28. In addition, the two exterior collecting chambers 6 and 10 are connected via a conduit 30 that, at the front end of the collecting chamber 6 opposite the outlet 12, opens into the collecting chamber 6. In this arrangement, even though the exemplary embodiment of FIG. 7 is made up of two heat exchangers 24, 26, as in the examples of FIGS. 5 and 6, it has only two external connections, namely one inlet 8 and one outlet 12. The conduits 28, 30 can be designed as pipe lines or hose lines. In all of the exemplary embodiments, pressure-actuated bypass valve devices can be disposed between inlet sides and outlet sides.

While various embodiments have been chosen to illustrate the invention, it will be understood by those skilled in the art that various changes and modifications can be made therein without departing from the scope of the invention as defined in the claims.

The invention claimed is:

1. A heat exchanging device for exchanging heat between air and a fluid, the device comprising:

first and second fluid-air heat exchangers;

fluid-conducting first and second exterior collecting chambers each having a fluid inlet or a fluid outlet;

first and second sets of fluid guides of said first and second heat exchangers being respectively connected in fluid communication with said first and second exterior collecting chambers;

air guides for conducting an air flow for heat transfer between the air flow and fluid flowing in said fluid guides, said air guides being separated and sealed from said fluid guides to prevent fluid communication therebetween; and fluid conducting third and fourth collecting chambers between and spaced from said first and second collecting chambers, all of said fluid guides of said first and second sets being connected in fluid communication with said third and fourth collecting chambers, respectively, said first set of fluid guides extending between said first and third collecting chambers, said second set of fluid guides extending between said second and fourth collecting chambers, said third collecting chamber having a fluid outlet, said fourth collecting chamber having a fluid inlet connected in fluid communication in series with said fluid outlet of said third collecting chamber such that fluid flows from said third collecting chamber to said fourth collecting chamber, said first exterior collecting chamber being connected in fluid communication in series to said second exterior collecting chamber via a conduit connected to one end of said first exterior collecting chamber, an outlet being connected to an opposite end of said first exterior collecting chamber.

2. The heat exchanging device according to claim 1 wherein said third and fourth collecting chambers are located centrally between said first and second exterior collecting chambers and are connected to said first and second exterior collecting chambers by said fluid guides, respectively.

3. The heat exchanging device according to claim 1 wherein said third and fourth collecting chambers are adjacent one another.

4. The heat exchanging device according to claim 1 wherein said first and second heat exchangers are disposed in a common plane.

5. The heat exchanging device according to claim 1 wherein said third and fourth collecting chambers have opposite flowthrough directions relative to one another in operation.

6. The heat exchanging device according to claim 1 wherein each of said collecting chambers have a same volume.

7. The heat exchanging device according to claim 1 wherein each of said collecting chambers is formed as a collecting box with a box length, each of said fluid guides opening into the respective collecting boxes along an entirety of the respective box length; and said air guides are arranged to convey the air flow in directions transverse to directions of fluid flow in said fluid guides between the respective collecting chambers.

8. The heat exchanging device according to claim 1 wherein a fan is disposed on a side of said fluid guides to increase air throughput.

* * * * *